US011285637B1

(12) United States Patent
Cao et al.

(10) Patent No.: US 11,285,637 B1
(45) Date of Patent: Mar. 29, 2022

(54) HIGH RELIABILITY MECHANICAL AUTOMATIC CERAMIC PLATE DRY PRESS DEVICE

(71) Applicant: Xinxing Electronic Ceramics Co., Ltd., Loudi (CN)

(72) Inventors: Jianping Cao, Loudi (CN); Peifu Cao, Loudi (CN); Jianhui Cao, Loudi (CN); Ping Liu, Loudi (CN)

(73) Assignee: Xinxing Electronic Ceramics Co., Ltd., Loudi (CN)

( * ) Notice: Subject to any disclaimer, the term of this patent is extended or adjusted under 35 U.S.C. 154(b) by 0 days.

(21) Appl. No.: 17/402,628

(22) Filed: Aug. 16, 2021

(30) Foreign Application Priority Data

Sep. 24, 2020 (CN) ..... 202011015281.X

(51) Int. Cl.
*B28B 7/00* (2006.01)
*B28B 13/06* (2006.01)
*B28B 3/02* (2006.01)

(52) U.S. Cl.
CPC ..... *B28B 7/0097* (2013.01); *B28B 3/02* (2013.01); *B28B 13/06* (2013.01)

(58) Field of Classification Search
CPC ..... B28B 7/0097; B28B 3/02
See application file for complete search history.

(56) References Cited

U.S. PATENT DOCUMENTS

2016/0290222 A1* 10/2016 He ..... F01C 21/18
2020/0039123 A1* 2/2020 Qu ..... B29C 43/58

FOREIGN PATENT DOCUMENTS

CN 201046584 * 4/2008
CN 105666651 * 11/2014
CN 208815353 U 5/2019
CN 209999400 U 1/2020
CN 213183996 U 5/2021

OTHER PUBLICATIONS

Machine English translation of CN201046584, Accessed Oct. 19, 2021 (Year: 2008).*
Machine English translation of CN105666651, Accessed Oct. 19, 2021 (Year: 2014).*

* cited by examiner

*Primary Examiner* — Francisco W Tschen
*Assistant Examiner* — Adrianna N Konves

(57) ABSTRACT

A high reliability mechanical automatic ceramic plate dry press device is provided, comprising: a frame, a lower pressure mould, an upper pressure mould, a mould sleeve, a lower pressure closure band, a return closure band and a discharging push plate; a lower pressure slot is provided inside of the lower pressure closure band; an end of the cross bar is provided with a lower pressure fixture block corresponding to the lower pressure slot; the lower pressure closure band is provided with teeth outside of a position of the lower pressure fixture block; the frame is provided with a slow pressure gear and a quick pressure gear corresponding to the teeth; the discharging push plate is located below the lower pressure closure band, and a toothed bar matched with teeth is provided at a top of the discharging push plate. The device can realize automatic continuous processing and high pressing efficiency.

10 Claims, 8 Drawing Sheets

HIGH RELIABILITY MECHANICAL AUTOMATIC CERAMIC PLATE DRY PRESS DEVICE

CROSS-REFERENCE TO RELATED APPLICATIONS

The application claims priority to Chinese patent application No. 202011015281X, filed on Sep. 24, 2020, the entire contents of which are incorporated herein by reference.

TECHNICAL FIELD

The present disclosure relates to the technical field of ceramic processing equipment, in particular to a high reliability mechanical automatic ceramic plate dry press device.

BACKGROUND

Dry pressing of ceramic plate is a kind of forming method which uses pressure to press the dry powder blank of zirconia ceramic plate into compact body in the model. Since that blank materials formed by dry pressing of ceramic plate have less moisture, great pressure and relatively compact body, a green body of zirconia ceramic plate with reduced shrinkage, accurate shape and no need for strong drying can be obtained.

The process of dry pressing of ceramic plate is simple, with large amount of production of the ceramic plate, small defects, and is convenient to mechanization, so it is suitable for the ceramic plate blank with simple shape and small size. Therefore, the dry pressing of ceramic plate has been widely used in industrial ceramics, and achieved good results. General method of dry pressing of ceramic plate is carried out by hydraulic cylinder or pneumatic cylinder, and its medium volume has shrinkage; and the general method has good pressing reliability for large-size ceramic plate, but it needs to be improved for small-size ceramic plate with high precision.

SUMMARY

The present disclosure aims to provide a high reliability mechanical automatic ceramic plate dry press device to improve the reliability of ceramic dry press through hydraulic cylinder or pneumatic cylinder in the prior art.

In order to achieve the above object, the present disclosure adopts the following technical solution:

the high reliability mechanical automatic ceramic plate dry press device comprises a frame, and the frame is provided with a lower pressure mould, an upper pressure mould, a mould sleeve, a lower pressure closure band, a return closure band and a discharging push plate, and the upper pressure mould, the lower pressure mould, and the mould sleeve form a mould.

Specifically, a top of the upper pressure mould is provided with a sliding sleeve and a cross bar slidably fitted with the sliding sleeve, and the cross bar can move laterally.

Further, lower pressure slot is provided inside of the lower pressure closure band; an end of the cross bar is provided with a lower pressure fixture block corresponding to the lower pressure slot; and the lower pressure closure band is provided with a teeth outside of a position of the lower pressure fixture block; and the frame is provided with a slow pressure gear and a quick pressure gear corresponding to the teeth.

Preferably, the slow pressure gear is located above the quick pressure gear; a diameter of the slow pressure gear is smaller than a diameter of the quick pressure gear; a shaft of the slow pressure gear synchronously connects with a shaft of the quick pressure gear through a third synchronous belt. The slow pressure gear rotates at the same angular speed as the quick pressure gear. As the tooth number of the slow pressure gear is less than the tooth number of the quick pressure gear, the linear speed of the slow pressure gear is less than the linear speed of the quick pressure gear.

Further, the slow pressure gear and the quick pressure gear are incomplete gears; the slow pressure gear is provided with two sets of teeth including lower pressure teeth and pushing teeth, and a space provided between the two sets of teeth; and the quick pressure gear is provided with continuous teeth; when the slow pressure gear meshes with the teeth of the lower pressure closure band, the quick pressure gear does not mesh with the teeth of the lower pressure closure band; and when the quick pressure gear meshes with the teeth of the lower pressure closure band, the slow pressure gear does not mesh with the teeth of the lower pressure closure band. The above process can simulate the normal pressing speed of general ceramic dry pressing mould.

Further, the discharging push plate is located below the lower pressure closure band; the discharging push plate is slidably connected with the frame; and a toothed bar matched with the teeth is provided at a top of the discharging push plate.

After the teeth of the lower pressure closure band successively pass the lower pressure teeth of the slow pressure gear and the quick pressure gear, the teeth of the lower pressure closure band can mesh with the toothed bar, and the teeth of the pressure closure belt can drive the toothed bar and the discharging push plate to move, which is used to the pressed mould discharging. When the teeth of the lower pressure closure band meshes with the toothed bar, the pushing teeth of the slow pressure gear meshes with the teeth of the lower pressure closure band, and the quick pressure gear does not mesh with the teeth of the lower pressure closure band.

Further, a sum of circumference angles corresponding to a teeth of the slow pressure gear and a teeth of the quick pressure gear is less than 360 degrees, and a coil spring is provided for returning the lower pressure closure band between a transmission shaft of the lower pressure closure band and the frame. When the teeth of the lower pressure closure band successively pass the slow pressure gear, the quick pressure gear and the toothed bar, the coil spring reverses the transmission shaft of the lower pressure closure band and realize the return of the lower pressure closure band.

Further, a return slot is provided outside the return closure band; and an other end of the cross bar is provided with a return fixture block corresponding to the return slot. When the teeth of the lower pressure closure band meshes with the toothed bar, the return fixture block of the cross bar is clamped into the return slot, and the return closure band drives the cross bar and the upper pressure mould to move up to realize the return of the upper pressure mould.

Preferably, the high reliability mechanical automatic ceramic plate dry press device further comprises coupling transmission components which are used to form a dynamic coupling between the lower pressure closure band and the return closure band; and the coupling transmission components includes a first synchronous belt, a meshed main drive gear and a meshed passive gear, a second synchronous belt; and the second synchronous belt synchronously connects with a shaft of the main drive gear and a transmission shaft corresponding to a shaft of the lower pressure closure band.

Preferably, the upper end of the cross bar is provided with a push plate; the first synchronous belt is provided in a horizontal direction; a transverse pushing plate corresponding to the push plate is fixedly provided on a lower side of the first synchronous belt. During the operation of the first synchronous belt, the transverse pushing plate pushes the push plate and horizontally moves the cross bar, and a return spring is provided between the push plate of the cross bar and the slide sleeve to facilitate the return of the cross bar.

In order to realize the operation of the whole equipment, the lower pressure mould of the automatic discharging ceramic dry pressing forming equipment is also provided with the upper pressure closure band corresponding to the lower pressure closure band, and the upper pressure closure band can drive the lower pressure mould to press up and realize two-way dry pressing.

Further, a push-up gear corresponding to the slow pressure gear is provided on a side of the upper pressure closure band; and the push-up gear is the incomplete gear; and the push-up gear is provided with two sets of teeth, and a space provided between the two sets of teeth including upper pressure teeth and push-up teeth. When the teeth of the lower pressure closure band meshes with the rack for a period of time, the push-up gear stops rotating, and the pressed mould is kept at the upper end of the mould sleeve, so that a discharging push plate can push the mould out easily.

The machining process of the high reliability mechanical automatic ceramic plate dry press device is:

slow pressure process: under the action of the return spring, the lower pressure fixture block at one end of the cross bar is clamped into the lower pressure slot of the lower pressure closure band, the teeth of the lower pressure closure band is meshed with the lower pressure teeth of the slow pressure gear, the quick pressure gear is not meshed with the teeth of the lower pressure closure band, the slow pressure gear pulls the lower pressure closure band and moves the upper pressure mould downward, and slowly presses the mould in the mould sleeve;

in this process, the first synchronous belt drives the transverse pushing plate to move;

rapid pressure process: the lower pressure teeth of the slow pressure gear is separated from the teeth of the lower pressure closure band, the quick pressure gear pulls the lower pressure closure band and moves the upper pressure mould downward, and slowly presses the mould in the mould sleeve;

in this process, the first synchronous belt drives the transverse pushing plate to move continuously; the transverse pushing plate push the push plate to the cross bar; when the upper pressure mould reaches the target position, the lower pressure fixture block is separated from the lower pressure slot of the lower pressure closure band;

discharge process: the teeth of the quick pressure gear is separated from the teeth of the lower pressure closure band, the pushing teeth of the slow pressure gear meshes up with the teeth of the lower pressure closure band, the slow pressure gear continues to pull the lower pressure closure band to make the teeth of the lower pressure closure band mesh with the toothed bar; and the discharging push plate starts moving, and gradually approach the cavity of the mould sleeve; and the push-up gear continues to pull the upper pressure closure band, makes lower pressure mould move upward and pushes the mould from the cavity of the mould sleeve;

in this process, the return fixture block at an end of the cross rod is clamped into the return slot of the return closure band;

pushing process: the slow pressure gear continues to pull the lower pressure closure band, and discharging push plate continues to moving and pushes the mould away from the cavity of the mould sleeve;

in this process, the return closure band drives the cross bar to move upward and return;

return process: the discharging push plate completes pushing, and the teeth of the quick pressure gear is separated from the teeth of the lower pressure closure band; under the action of the coil spring, the transmission shaft of the lower pressure closure band reverses and realizes the return of the lower pressure closure band. At this time, the discharging push plate and the transverse pushing plate also return, and the return spring returns the cross bar, the lower pressure fixture block at the end of the cross bar continues to be clamped into the lower pressure slot of the lower pressure closure band.

Preferably, the frame is provided with a conveyor belt on a side of the mould sleeve, and a position of the discharging push plate corresponds to a position of the conveyor belt, and the discharging push plate can push the mould directly onto the conveyor belt to realize the automatic feeding of mould.

The beneficial effects of the present disclosure are: the high reliability mechanical automatic ceramic plate dry press device realizes the process of the slow pressure process, the rapid pressure process and the discharge process by setting the lower pressure closure band and the return closure band and adopting mechanical structure, and has compact structure and can realize multiple reliable press; the high reliability mechanical automatic ceramic plate dry press device can realize automatic continuous processing and high pressing efficiency and is especially suitable for small size, precision requirements high plate ceramics dry pressure.

DETAILED DESCRIPTION OF THE EMBODIMENTS

The technical solution in the embodiment of the present disclosure will be clearly and completely described in conjunction with the drawings in the embodiment of the present disclosure. Apparently, the embodiment described is only one of the embodiments of the present disclosure and not all of them.

Figure 1:
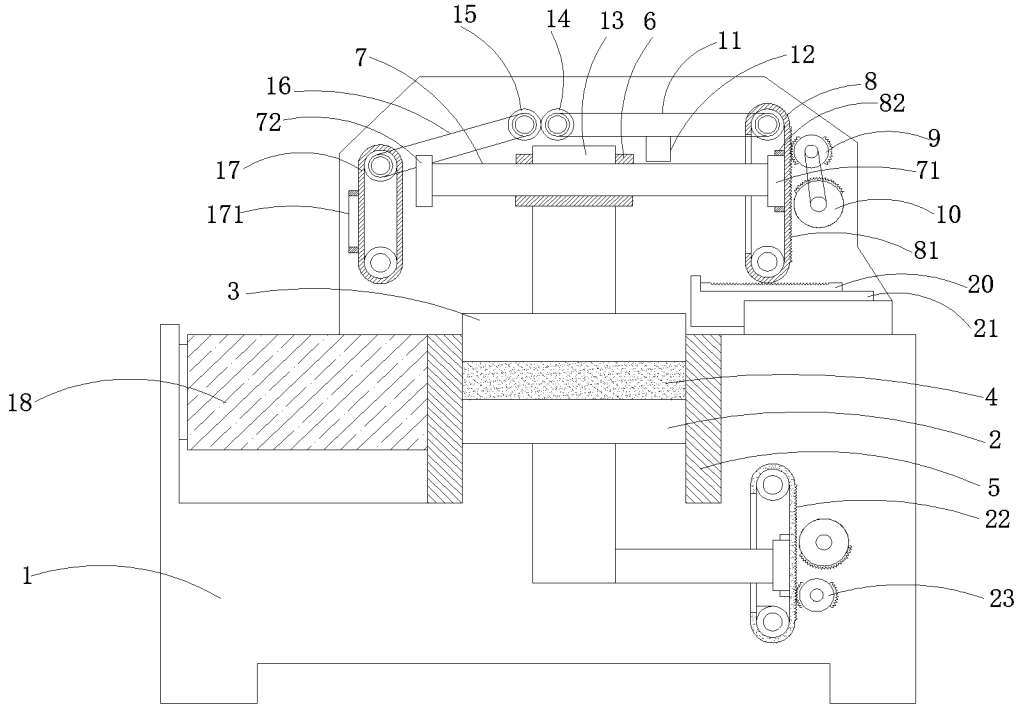
FIG. 1 shows a structure diagram of the high reliability mechanical automatic ceramic plate dry press device.

Referring to FIG. 1, the high reliability mechanical automatic ceramic plate dry press device comprises a frame 1, and the frame 1 is provided with a lower pressure mould 2, an upper pressure mould 3, a mould sleeve 5, a lower pressure closure band 8, a return closure band 17 and a discharging push plate 21, and the upper pressure mould 3, the lower pressure mould 2, and the mould sleeve 5 form a pressed mould 4. The lower pressure mould 2 and the upper pressure mould 3 are slidably connected to the frame 1.

Specifically, a top of the upper pressure mould 3 is provided with a sliding sleeve 6 and a cross bar 7 slidably fitted with the sliding sleeve 6, and the cross bar 7 can move laterally.

Further, a lower pressure slot 82 is provided inside of the lower pressure closure band 8; an end of the cross bar 7 is provided with a lower pressure fixture block 71 corresponding to the lower pressure slot 82; and a through-hole is provided on the other inner side of the lower pressure closure band 8 so that the lower pressure fixture block 71 can be smoothly engaged in the lower pressure slot 82.

Further, the lower pressure closure band 8 is provided with teeth outside of a position of the lower pressure fixture block 71; and the frame 1 is provided with a slow pressure gear 9 and a quick pressure gear 10 corresponding to the teeth. The slow pressure gear 9 and the quick pressure gear 10 are respectively rotationally connected to frame 1.

Preferably, the slow pressure gear 9 is located above the quick pressure gear 10; a diameter of the slow pressure gear 9 is smaller than a diameter of the quick pressure gear 10; a shaft of the slow pressure gear 9 synchronously connects with a shaft of the quick pressure gear 10 through a third synchronous belt 19. The slow pressure gear 9 rotates at the same angular speed as the quick pressure gear 10. As the tooth number of the slow pressure gear 9 is less than the tooth number of the quick pressure gear 10, the linear speed of the slow pressure gear 9 is less than the linear speed of the quick pressure gear 10.

Further, the slow pressure gear 9 and the quick pressure gear 10 are incomplete gears; the slow pressure gear 9 is provided with two sets of teeth including lower pressure teeth 91 and pushing teeth 92, and a space provided between the two sets of teeth; and the quick pressure gear 10 is provided with a continuous teeth; when the lower pressure teeth 91 or the pushing teeth 92 of the slow pressure gear 9 meshes with a teeth 81 of the lower pressure closure band 8, the lower pressure closure band 8 is in slow operation, and at this time, the quick pressure gear 10 does not mesh with the teeth 81 of the lower pressure closure band 8; and when the quick pressure gear 10 meshes with the teeth 81 of the lower pressure closure band 8, the lower pressure closure band 8 is in quick operation, and at this time, the slow pressure gear 9 does not mesh with the teeth 81 of the lower pressure closure band 8. The above process can simulate the normal pressing speed of general ceramic dry pressing mould.

Further, the discharging push plate 21 is located below the lower pressure closure band 8; the discharging push plate 21 is slidably connected with the frame 1; and a toothed bar 20 matched with the teeth 81 is provided at a top of the discharging push plate 21.

After the teeth 81 of the lower pressure closure band 8 successively pass the lower pressure teeth 91 of the slow pressure gear 9 and the quick pressure gear 10, the teeth 81 of the lower pressure closure band 8 can mesh with the toothed bar 20, and the teeth 81 of the pressure closure belt can drive the toothed bar 20 and the discharging push plate 21 to move, which is used to the pressed mould 4 discharging. When the teeth 81 of the lower pressure closure band 8 meshes with the toothed bar 20, the pushing teeth 92 of the slow pressure gear 9 meshes with the teeth 81 of the lower pressure closure band 8, and the quick pressure gear 10 does not mesh with the teeth 81 of the lower pressure closure band 8.

Further, a sum of circumference angles corresponding to a teeth of the slow pressure gear 9 and a teeth of the quick pressure gear 10 is less than 360 degrees, and a coil spring is provided for returning the lower pressure closure band 8 between a transmission shaft of the lower pressure closure band 8 and the frame 1. When the teeth 81 of the lower pressure closure band 8 successively pass the slow pressure gear 9, the quick pressure gear 10 and the toothed bar 20, the coil spring reverses the transmission shaft of the lower pressure closure band 8 and realize the return of the lower pressure closure band 8.

Further, a return slot 171 is provided outside the return closure band 17; and an other end of the cross bar 7 is provided with a return fixture block 72 corresponding to the return slot 171. When the teeth 81 of the lower pressure closure band 8 meshes with the toothed bar 20, the return fixture block 72 of the cross bar 7 is clamped into the return slot 171, and the return closure band 17 drives the cross bar 7 and the upper pressure mould 3 to move up to realize the return of the upper pressure mould 3.

In the present embodiment, the high reliability mechanical automatic ceramic plate dry press device further comprises coupling transmission components which are used to form a dynamic coupling between the lower pressure closure band 8 and the return closure band 17; and the coupling transmission components includes a first synchronous belt 11, a meshed main drive gear 14 and a meshed passive gear 15, a second synchronous belt 16; and the second synchronous belt 16 synchronously connects with a shaft of a main drive gear 14 and a transmission shaft corresponding to a shaft of the lower pressure closure band 8. The first synchronous belt 11 synchronously connects a shaft of the passive gear 15 and a transmission shaft of the return closure band 17. By means of the first synchronous belt 11 and the second synchronous belt 16, the power transmission between the lower pressure closure band 8 and the return closure band 17 can be realized to make the whole apparatus more compact.

In the present embodiment, the upper end of the cross bar 7 is provided with a push plate 13; the first synchronous belt 11 is provided in a horizontal direction; a transverse pushing plate 12 corresponding to the push plate 13 is provided on a lower side of the first synchronous belt 11. During the operation of the first synchronous belt 11, the transverse pushing plate 12 pushes the push plate 13 and horizontally moves the cross bar 7, and a return spring is provided between the push plate 13 of the cross bar 7 and the slide sleeve to facilitate the return of the cross bar 7. When the transverse pushing plate 12 moves away from the push plate 13, the push plate 13 can return to the position.

Figure 8:
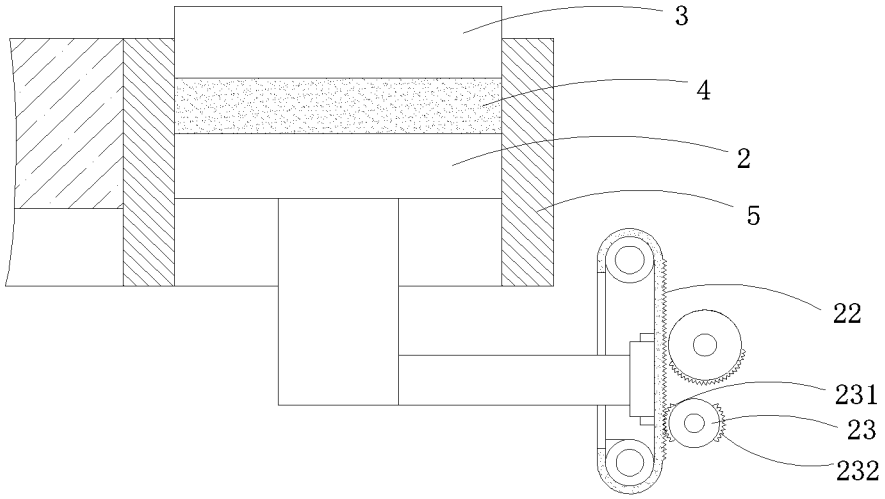
FIG. 8 shows the structure diagram of the upper pressure closure band.

Referring to FIG. 8, in order to realize the operation of the whole equipment, the lower pressure mould 2 of the automatic discharging ceramic dry pressing forming equipment is also provided with the upper pressure closure band 22 corresponding to the lower pressure closure band 8, and the upper pressure closure band 22 can drive the lower pressure mould 2 to press up and realize two-way dry pressing. Two gears for quick and slow pressing are provided on the side of the upper pressure closure band 22, one of the gears is provided with a driver, such as a motor which is used for the operation of the upper pressure closure band 22. The return of the upper pressure closure band 22 is performed by the reverse rotation of the driver.

Further, a push-up gear 23 corresponding to the quick pressure gear 10 is provided on a side of the upper pressure closure band 22; and the push-up gear 23 is the incomplete gear; and the push-up gear 23 is provided with two sets of teeth including upper pressure teeth 231 and push-up teeth 232, and a space is provided between the upper pressure teeth 231 and the push-up teeth 232. When the teeth 81 of the lower pressure closure band 8 meshes with the toothed bar 20 for a period of time, the push-up gear 23 stops rotating, and the pressed mould 4 is kept at the upper end of the mould sleeve 5, so that a discharging push plate 21 can push the pressed mould 4 out easily. When the pressed mould 4 is pushed out, the push-up gear 23 rotates in the direction to return.

In the present embodiment, the frame 1 is provided with a conveyor belt 18 on a side of the mould sleeve 5, and a position of the discharging push plate 21 corresponds to a position of the conveyor belt 18 and the discharging push plate 21 can push pressed mould 4 directly onto the conveyor belt 18 to realize the automatic feeding of the pressed mould 4.

Figure 2:
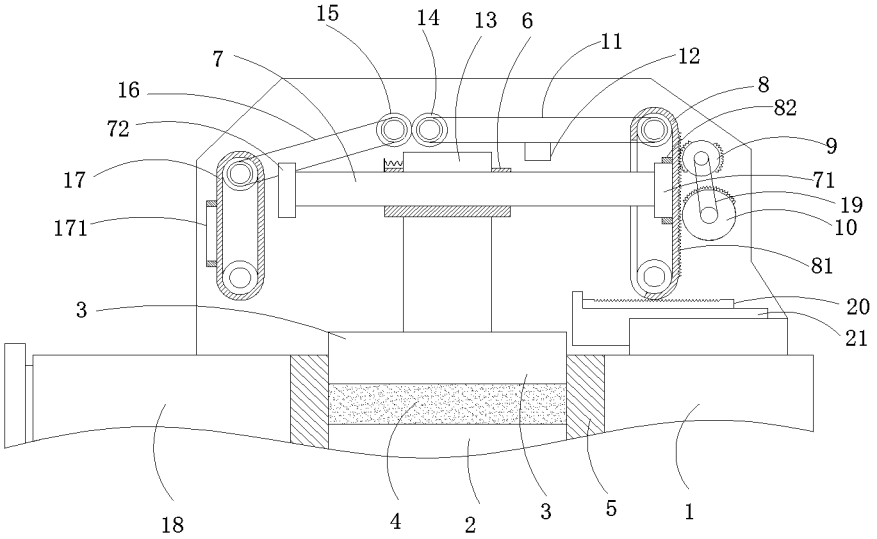
FIG. 2 shows the structure diagram of the slow pressure structure of the upper pressure mould of the high reliability mechanical automatic ceramic plate dry press device.
Figure 3:
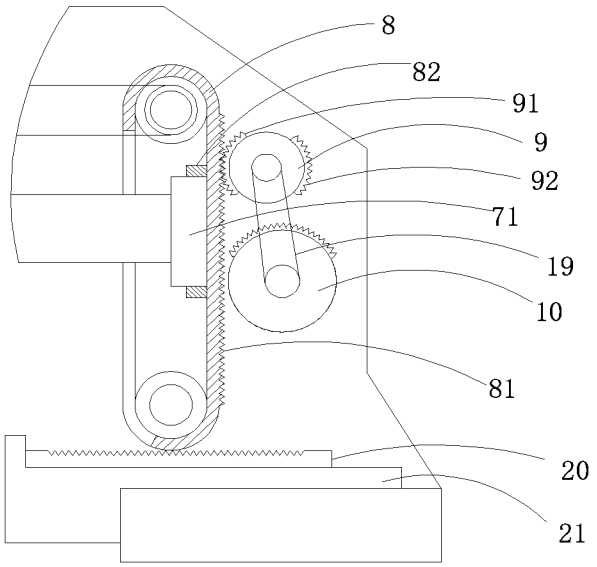
FIG. 3 shows the structure diagram of the meshing between the lower pressure closure band and the slow pressure gear of the high reliability mechanical automatic ceramic plate dry press device.
Figure 4:
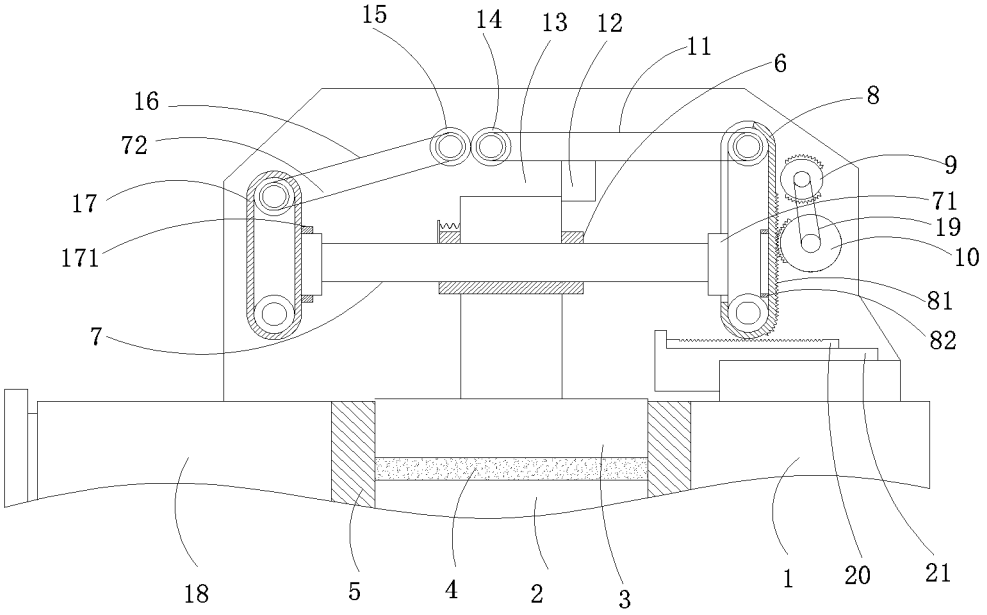
FIG. 4 shows the structure diagram of the rapid pressure structure of the upper pressure mould of the high reliability mechanical automatic ceramic plate dry press device.
Figure 5:
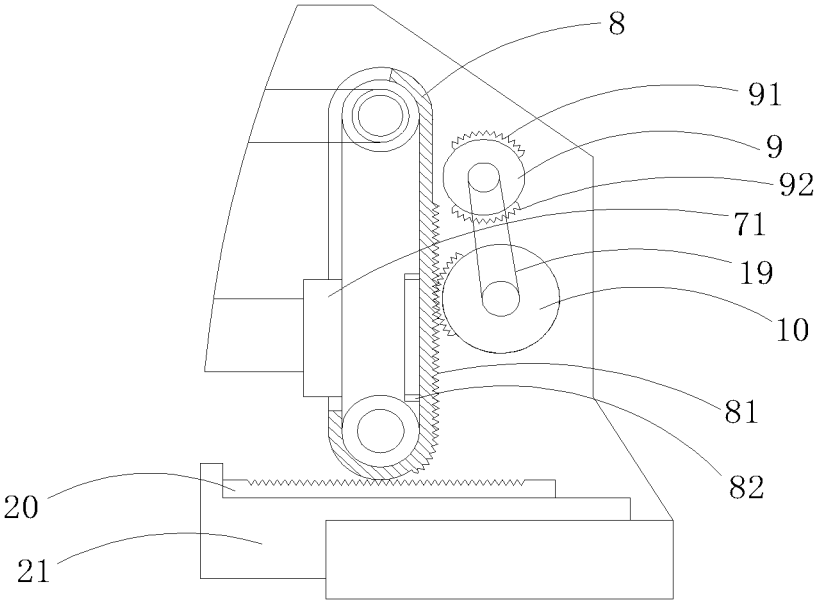
FIG. 5 shows the structure diagram of the meshing between the lower pressure closure band and the quick pressure gear of the high reliability mechanical automatic ceramic plate dry press device.
Figure 6:
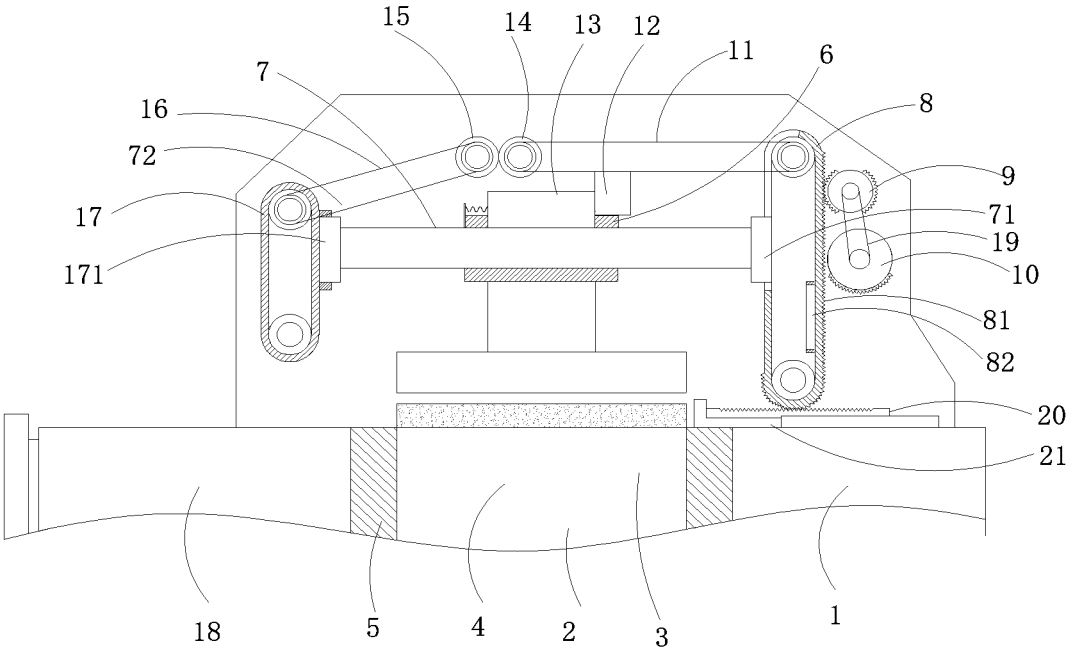
FIG. 6 shows the structure diagram when the pressed mould of the high reliability mechanical automatic ceramic plate dry press device is discharging.
Figure 7:
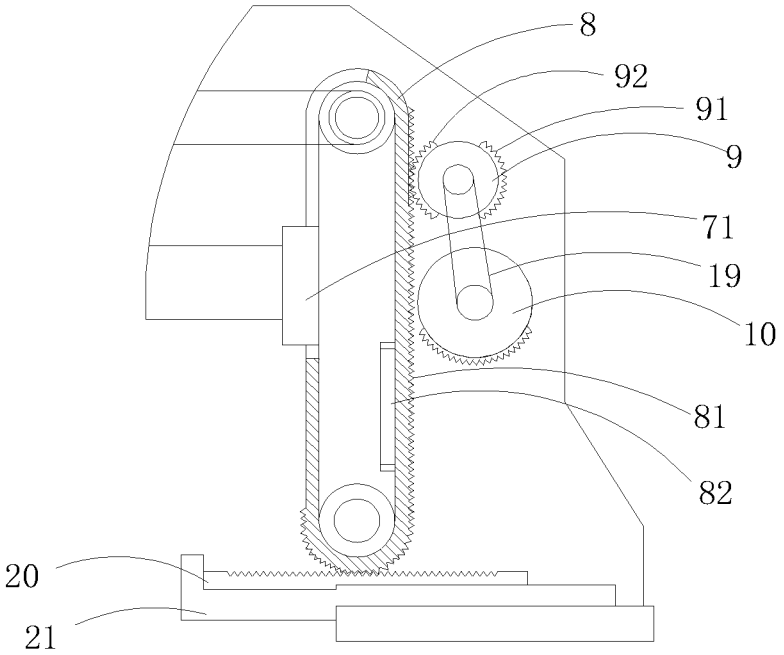
FIG. 7 shows the structure diagram of the meshing between the lower pressure closure band and the toothed bar of the high reliability mechanical automatic ceramic plate dry press device.

The machining process of the high reliability mechanical automatic ceramic plate dry press device is:

slow pressure process: referring to FIG. 2 and FIG. 3, under the action of the return spring, the lower pressure fixture block 71 at one end of the cross bar 7 is clamped into the lower pressure slot 82 of the lower pressure closure band 8, the teeth 81 of the lower pressure closure band 8 is meshed with the lower pressure teeth 91 of the slow pressure gear 9, the quick pressure gear 10 is not meshed with the teeth 81 of the lower pressure closure band 8, and a drive motor is provided at one end of the slow pressure gear 9. the slow pressure gear 9 pulls the lower pressure closure band 8 and moves the upper pressure mould 3 downward, and at the same time, the upper pressure teeth 231 of the push-up gear 23 pulls the upper pressure closure band 22, and presses the lower pressure mould 2 up, and slowly presses the mould in the mould sleeve 5;

in this process, the first synchronous belt 11 drives the transverse pushing plate 12 to move;

rapid pressure process: referring to FIG. 4 and FIG. 5, the lower pressure teeth 91 of the slow pressure gear 9 is separated from the teeth 81 of the lower pressure closure band 8, through the connection of the third synchronous belt 19, the quick pressure gear 10 can pull the lower pressure closure band 8 to move the upper pressure mould 3 downward; in the same way, the lower pressure mould 2 moves upward to rapidly press the mould in the mould sleeve 5;

in this process, the first synchronous belt 11 drives the transverse pushing plate 12 to move continuously; the transverse pushing plate 12 push the push plate 13 to the cross bar 7; when the upper pressure mould 3 reaches the target position, the lower pressure fixture block 71 is separated from the lower pressure slot 82 of the lower pressure closure band 8;

discharge process: referring to FIG. 6 and FIG. 7, the teeth of the quick pressure gear 10 is separated from the teeth 81 of the lower pressure closure band 8, the pushing teeth 92 of the slow pressure gear 9 meshes up with the teeth 81 of the lower pressure closure band 8, the slow pressure gear 9 continues to pull the lower pressure closure band 8 to make the teeth 81 of the lower pressure closure band 8 mesh with the toothed bar 20; and the discharging push plate 21 starts moving, and gradually approach the cavity of the mould sleeve 5; and the push-up teeth 232 of the push-up gear 23 continues to pull the upper pressure closure band 22, makes lower pressure mould 2 move upward and pushes the pressed mould 4 from the cavity of the mould sleeve 5;

in this process, the return fixture block 72 at an end of the cross rod is clamped into the return slot 171 of the return closure band 17;

pushing process: the slow pressure gear 9 continues to pull the lower pressure closure band 8, and discharging push plate 21 continues to moving and pushes the pressed mould 4 away from the cavity of the mould sleeve 5 and into the conveyor belt 18;

in this process, the return closure band 17 drives the cross bar 7 to move upward and return;

return process: the discharging push plate 21 completes pushing, and the teeth of the quick pressure gear 10 is separated from the teeth 81 of the lower pressure closure band 8; under the action of the coil spring, the transmission shaft of the lower pressure closure band 8 reverses and realizes the return of the lower pressure closure band 8. At this time, the discharging push plate 21 and the transverse pushing plate 12 also return, and the return spring returns the cross bar 7, the lower pressure fixture block 71 at the end of the cross bar 7 continues to be clamped into the lower pressure slot 82 of the lower pressure closure band 8. The lower pressure mould 2 also returns by the reverse rotation of the driver corresponding to the upper pressure closure band 22.

The high reliability mechanical automatic ceramic plate dry press device of the present embodiment adopts mechanical structure to realize the process of the slow pressure process, the rapid pressure process and the discharge process, and has compact structure and can realize multiple reliable press; the high reliability mechanical automatic ceramic plate dry press device can realize automatic continuous processing and high pressing efficiency.

The above-mentioned embodiment is only a preferred embodiment of the present disclosure, and cannot be used to limit the scope of rights of the present disclosure. Any modifications, equivalent changes, improvements, etc. made according to the scope of the present disclosure by any technical personnel familiar with the technical field within the technical range revealed by the present disclosure still belong to the protection scope of the present disclosure.

What is claimed is:

1. A high reliability mechanical automatic ceramic plate dry press device, comprising: a frame, a lower pressure mould, an upper pressure mould, a mould sleeve, a lower pressure closure band, a return closure band and a discharging push plate; and a top of the upper pressure mould is provided with a sliding sleeve and a cross bar slidably fitted with the sliding sleeve;

a lower pressure slot is provided inside of the lower pressure closure band; an end of the cross bar is provided with a lower pressure fixture block corresponding to the lower pressure slot; and the lower pressure closure band is provided with a set of teeth outside of a position of the lower pressure fixture block; the frame is provided with a slow pressure gear and a quick pressure gear corresponding to the teeth, and the slow pressure gear and the quick pressure gear are incomplete gears; the slow pressure gear is provided with two sets of teeth, and a space provided between the two sets of teeth; and the quick pressure gear is provided with a set of continuous teeth;

the discharging push plate is located below the lower pressure closure band; the discharging push plate is slidably connected with the frame; and a toothed bar matched with the set of teeth of the lower pressure closure band is provided at a top of the discharging push plate; and a return slot is provided outside the return closure band; and an other end of the cross bar is provided with a return fixture block corresponding to the return slot.

2. The high reliability mechanical automatic ceramic plate dry press device according to claim 1, wherein: the slow pressure gear is located above the quick pressure gear; a diameter of the slow pressure gear is smaller than a diameter of the quick pressure gear; and a shaft of the slow pressure gear synchronously connects with a shaft of the quick pressure gear through a third synchronous belt.

3. The high reliability mechanical automatic ceramic plate dry press device according to claim 2, wherein: when the slow pressure gear meshes with the teeth of the lower pressure closure band, the quick pressure gear does not mesh with the teeth of the lower pressure closure band; and when the quick pressure gear meshes with the teeth of the lower pressure closure band, the slow pressure gear does not mesh with the teeth of the lower pressure closure band.

4. The high reliability mechanical automatic ceramic plate dry press device according to claim 3, wherein: a sum of circumference angles corresponding to the teeth of the slow pressure gear and teeth of the quick pressure gear is less than 360 degrees.

5. The high reliability mechanical automatic ceramic plate dry press device according to claim 4, wherein: a coil spring is provided for returning the lower pressure closure band between a transmission shaft of the lower pressure closure band and a frame.

6. The high reliability mechanical automatic ceramic plate dry press device according to claim 1, wherein: coupling transmission components which are used to form a dynamic coupling between the lower pressure closure band and the return closure band; and the coupling transmission components includes a first synchronous belt, a meshed main drive gear and a meshed passive gear, a second synchronous belt; and the second synchronous belt synchronously connects with a shaft of a main drive gear and a transmission shaft corresponding to the lower pressure closure band; and the first synchronous belt synchronously connects with a shaft of a passive gear and a transmission shaft of the return closure band.

7. The high reliability mechanical automatic ceramic plate dry press device according to claim 6, wherein: an upper end of the cross bar is provided with a push plate; the first synchronous belt is provided in a horizontal direction; a transverse pushing plate corresponding to the push plate is fixedly provided on a lower side of the first synchronous belt.

8. The high reliability mechanical automatic ceramic plate dry press device according to claim 7, wherein: a return spring is provided between the push plate of the cross bar and the sliding sleeve.

9. The high reliability mechanical automatic ceramic plate dry press device according to claim 1, wherein: the lower pressure mould is also provided with an upper pressure closure band corresponding to the lower pressure closure band; and a push-up gear corresponding to the slow pressure gear is provided on a side of the upper pressure closure band; and the push-up gear is an incomplete gear; and the push-up gear is provided with two sets of teeth, and a space provided between the two sets of teeth.

10. The high reliability mechanical automatic ceramic plate dry press device according to claim 1, wherein: the frame is provided with a conveyor belt on a side of the mould sleeve; and a position of the discharging push plate corresponds to a position of the conveyor belt.

* * * * *